US007134626B2

(12) United States Patent
Kewin

(10) Patent No.: US 7,134,626 B2
(45) Date of Patent: Nov. 14, 2006

(54) TUBULAR CORE ASSEMBLIES FOR ROLLS OF PAPER OR OTHER SHEET MATERIAL

(76) Inventor: Daniel D. Kewin, 16 Dogwood Drive, Brantford (CA) N3R 1R3

( * ) Notice: Subject to any disclaimer, the term of this patent is extended or adjusted under 35 U.S.C. 154(b) by 0 days.

(21) Appl. No.: 11/012,221

(22) Filed: Dec. 16, 2004

(65) Prior Publication Data

US 2006/0151662 A1 Jul. 13, 2006

(51) Int. Cl.
*B65H 75/18* (2006.01)

(52) U.S. Cl. ..... 242/611; 242/610; 242/613.5

(58) Field of Classification Search ..... 242/613.4, 242/613.5, 610, 611, 611.2, 610.6; 464/183, 464/179, 185
See application file for complete search history.

(56) References Cited

U.S. PATENT DOCUMENTS 1,459,241 A * 6/1923 Norstrom ..... 242/611.2
2,465,995 A * 4/1949 Bergsten ..... 242/611.2
3,627,220 A * 12/1971 Vogel ..... 242/613.5
3,840,194 A * 10/1974 Vetter ..... 242/613.5
4,690,345 A * 9/1987 Cotey ..... 242/613.5
5,236,141 A * 8/1993 Kewin ..... 242/611.2
5,595,356 A * 1/1997 Kewin ..... 242/613.5
5,615,845 A * 4/1997 Kewin ..... 242/613.5
5,829,713 A * 11/1998 Kewin ..... 242/613.5

OTHER PUBLICATIONS

Sonoco Products Company, Sonoco Paper Mill Cores and Machinery Brochure, 1982.

* cited by examiner

*Primary Examiner*—Kathy Matecki
*Assistant Examiner*—William E. Dondero

(57) ABSTRACT

A stand-alone lug of non-isotropic polymeric or cellulosic material for installation in a recess in a core member of paperboard material for a roll of paper or other sheet material. The lug has a width in the range of from about 0.25 to about 4 inches, a length in the range of from about 0.5 to about 4 inches, and a thickness in the range of from about 0.25 to about 1 inch. The lug also having at least one radially inner surface, the total circumferential width of the inner surface or surfaces being at least about 0.2 inches. The lug may have a recess extending from one end for receiving a key on a stub-chuck. Where the lug is to be used with splined stub-chucks, the lug may have no recess.

19 Claims, 3 Drawing Sheets

TUBULAR CORE ASSEMBLIES FOR ROLLS OF PAPER OR OTHER SHEET MATERIAL

FIELD OF INVENTION

This invention relates to tubular core assemblies for rolls of paper or other sheet material.

BACKGROUND OF INVENTION

After manufacture, paper such as newsprint paper is conventionally wound on hollow cylindrical core members of paperboard material which, for winding paper thereon to form a roll and unwinding paper therefrom, are mounted on winding or unwinding equipment which has a pair of spaced stub-chucks which engage in opposite ends of a tubular core member. To prevent the core member itself from being damaged by the stub-chucks, it is also conventional to provide the ends of the tubular core members with some kind of reinforcement. A common type of reinforcement comprises a tubular cap member of sheet metal with a U-shaped section which fits over an end of the core member such that an inner annular wall of the cap member engages the inner wall of the core member and an outer annular wall of the cap member engages the outer wall of the core member.

Particular problems arise when paper is being unwound from a roll and fed to a printing press. To maintain a desired tension in the paper being fed to a printing press, it is necessary to provide means to apply a braking force to the roll. This is usually done by providing a braking force to one of the stub-chucks which transmits the braking force to the core member. At least one stub-chuck at an unwinding station may be provided with one or more keys which engage in one or more notches in an end of the core member and/or cap member or may be provided with axially extending splines which engage the inner surface of a core member which has no end reinforcement.

Unfortunately, a metal cap member being isotropic will assist in transmitting cyclical shocks from a stub-chuck and chuck key to an unwinding paper web, especially after chuck wear has occurred with resultant deterioration in the quality of printing on the paper web. Also, splines on a braking stub shaft tend to damage the inner surface of the core member, with resultant loss of proper braking control and resultant deterioration of print quality.

It is therefore an object of this invention to provide a tubular core assembly which at least substantially overcomes these problems.

SUMMARY OF INVENTION

According to the present invention, a tubular core assembly for a roll of paper or other sheet material has a hollow cylindrical core member formed of paperboard material, said core member having a recess extending axially inwardly from an end thereof and radially outwardly from an inner surface thereof at least partway to an outer surface thereof, and a stand-alone lug of non-isotropic polymeric or cellulosic material fitted in the core member recess, the core member having an outer diameter in the range of from about 3 to about 14 inches and an inner diameter in the range of from about 2 to about 13 inches, the core member recess and the lug each having a circumferential width in the range of from about 0.25 to about 4 inches, an axial length in the range of from about 0.5 to about 4 inches, and a radial thickness in the range of from about 0.25 to about 1 inch, and the lug having at least one radially inner surface, the total circumferential width of the inner surface or surfaces of the lug being at least about 0.2 inches, preferably at least about 0.4 inches.

The lug may have a recess for receiving a key on a stub-chuck, said lug recess extending axially inwardly from an end of the lug adjacent said end of the core member. The lug recess may extend radially outwardly from an inner surface of the lug only partway to an outer surface thereof, whereby the lug has a roof portion over the recess. The lug recess may extend axially inwardly from said end of the lug less than halfway along the length of the lug. The core member recess and the lug recess may be rectangular in plan view. The lug recess may have a circumferential width in the range of from about 0.125 to about 3 inches and an axial length in the range of from about 0.25 to about 3.75 inches.

Alternatively, the lug may have an unrecessed lower surface extending for the circumferential width thereof for engagement by splines on a stub-chuck.

The lug may have an axially extending spline projecting from at least one side surface and digging into a side of the core member recess to assist in positioning the lug therein. The lug may have at least one rear spline projecting therefrom and digging into a rear surface of the core member recess to assist in positioning the lug therein. The lug may have a pair of stabilizers each projecting from the bottom of a respective side wall thereof adjacent an inner surface of the core member to stabilize the lug when engaged by a stub-chuck.

The present invention also provides a stand-alone lug of non-isotropic polymeric or cellulosic material for installation in a recess in a core member of paperboard material for a roll of paper or other sheet material, said lug having a width in the range of from about 0.25 to about 4 inches, a length in the range of from about 0.5 to about 4 inches, and a thickness in the range of from about 0.25 to about 1 inch, and said lug also having at least one radially inner surface, the total circumferential width of the inner surface or surfaces being at least about 0.2 inches, preferably at least about 0.4 inches.

The inner surface or surfaces of the lug preferably engage at least about 2.25% of the periphery of the stub-chuck.

DESCRIPTION OF THE DRAWINGS

Embodiments of the invention will now be described, with reference to the accompanying drawings, of which.

DESCRIPTION OF PREFERRED EMBODIMENTS

Figure 1:
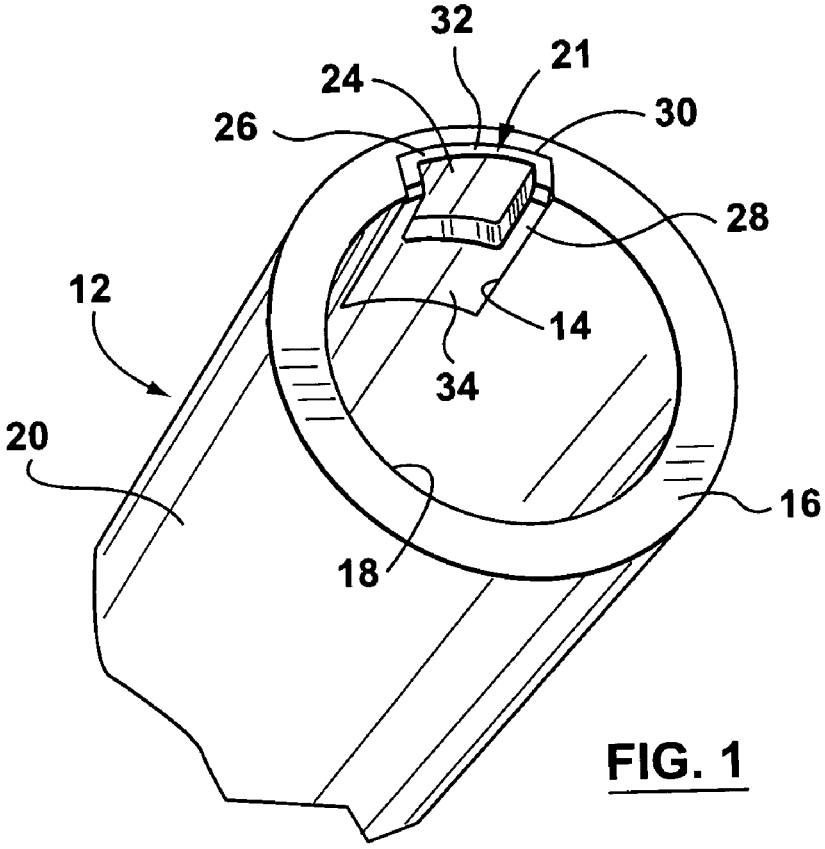
FIG. 1 is a perspective view of an end portion of a tubular core assembly in accordance with one embodiment of the invention.
Figure 2:
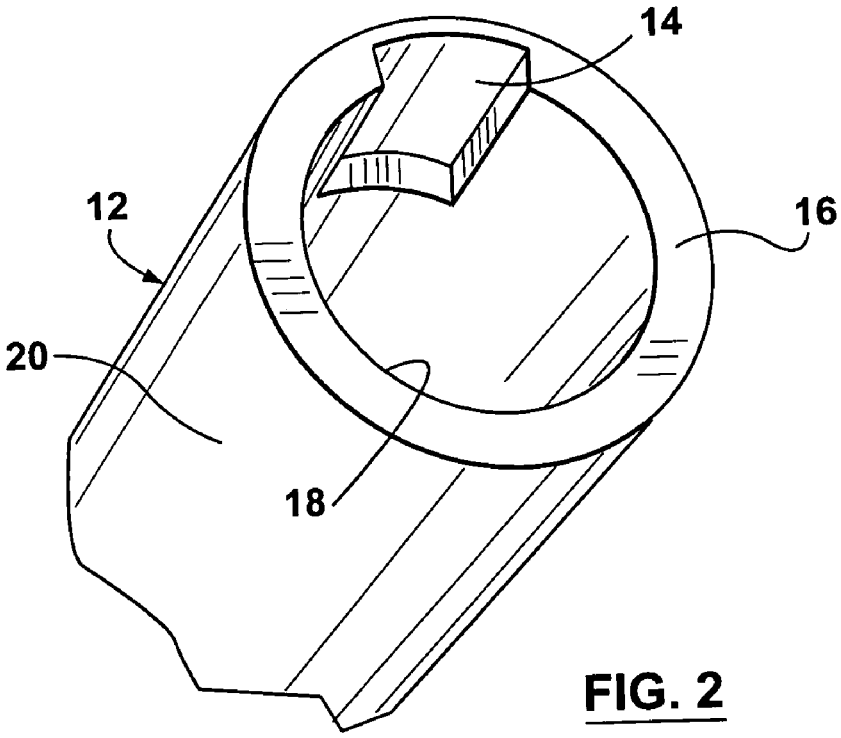
FIG. 2 is a similar view of the core member shown in FIG. 1.

Referring to the drawings, FIGS. 1 and 2 show a tubular core assembly for a roll of paper having a hollow cylindrical core member 12 of paperboard material helically wound in known manner. The core member 12 has a recess 14 extending axially inwardly from an end 16 thereof and radially outwardly from an inner surface 18 partway to an outer surface 20 thereof.

A stand-alone lug 21 of non-isotropic polymeric material, for example polycarbonate material, or cellulosic material, for example molded wood, is located in the core recess 14. The lug 21 has a recess 24 for receiving a key on a stub-shaft (as will be described in more detail later), the lug recess 24 extending axially inwardly from an end 26 of the lug 21 adjacent the end 16 of the core member 12. The lug recess 24 extends radially outwardly from an inner surface 28 of the lug 22 only partway to an outer surface 30 thereof, whereby the lug 21 has a roof portion 32 over the recess 24.

The lug recess 24 extends axially inwardly from the end 26 of the lug 21 slightly less than halfway along the length of the lug 21 so as to provide a substantial solid lug body portion 34 rearwardly of the recess 24. The total circumferential width of the portions of the inner surface 28 on the opposite sides of the recess 24 is at least about 0.4 inches.

Figure 3:
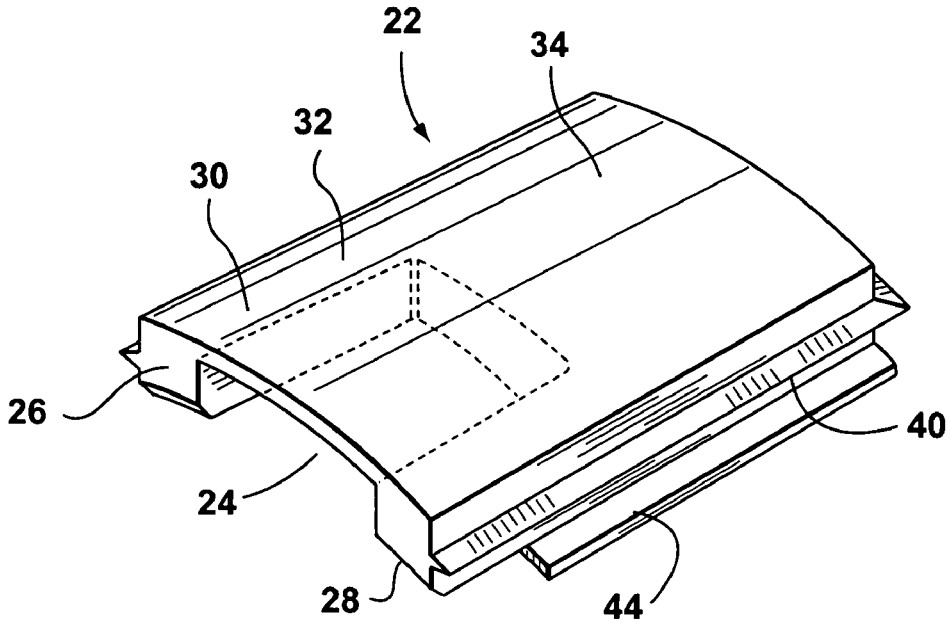
FIG. 3 is a similar view of a stand-alone lug in accordance with another embodiment of the invention.
Figure 4:
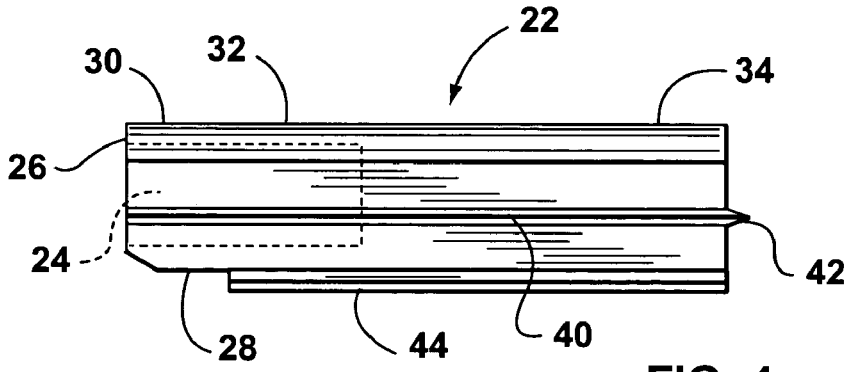
FIG. 4 is a side view of the lug.
Figure 5:
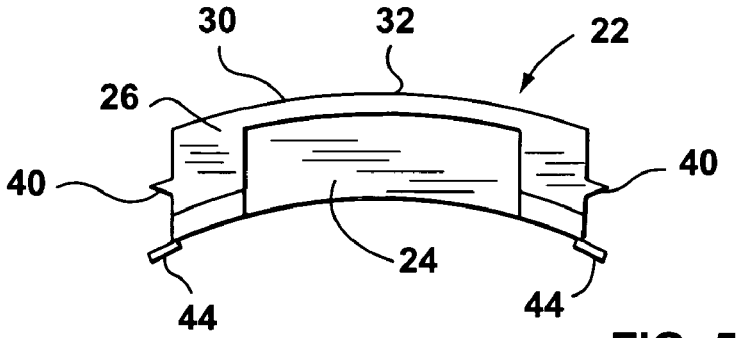
FIG. 5 is an end view of the lug.

FIGS. 3 to 5 show a lug 22 which also have axially extending splines 40 projecting from both sides thereof and at least one rear spline 42 projecting rearwardly therefrom which dig into the sides and rear of the core recess 14 to assist in positioning the lug 22 therein. The lug 22 is a friction fit in the core recess 14 and is also secured to the lug 22 by a suitable adhesive.

The lug 22 also has a pair of stabilizers 44 each projecting laterally outwardly from the bottom of a respective side wall adjacent an inner surface of the core member 12 to stabilize the lug 22 when engaged by a stub-chuck.

In one particular example of this embodiment, the core member 12 has an outer diameter of 4 inches, an inner diameter of 3 inches, and the core member recess 14 and the lug 22 each have a circumferential width of 1.187 inches, an axial length of 1.2 inches, and a radial thickness of 0.4 inches. The lug recess 24 has a circumferential width of 0.75 inches and an axial length of 0.875 inches.

Figure 6:
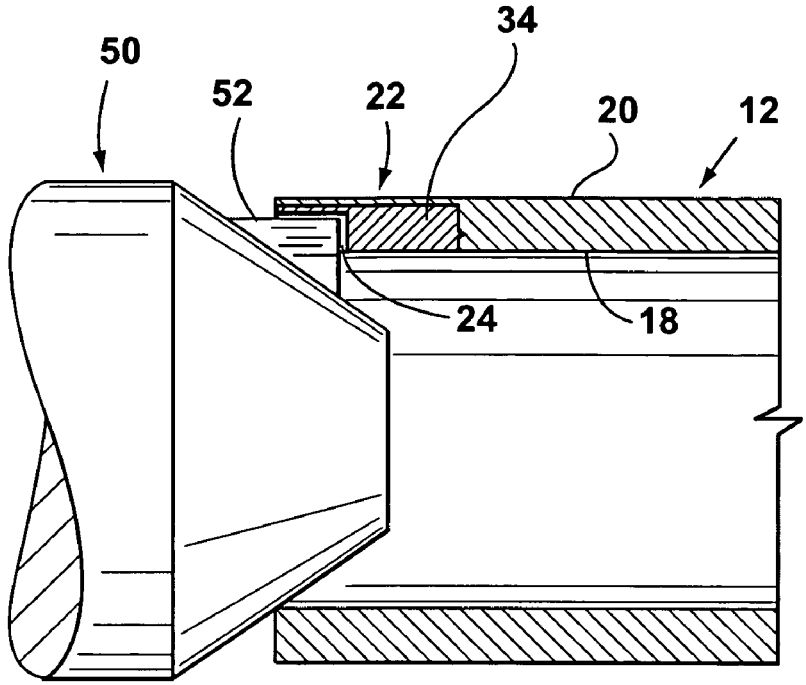
FIG. 6 is a sectional side view of the tubular core assembly of FIG. 1 engaged by a stub-shaft with a key engaged in the lug.
Figure 7:
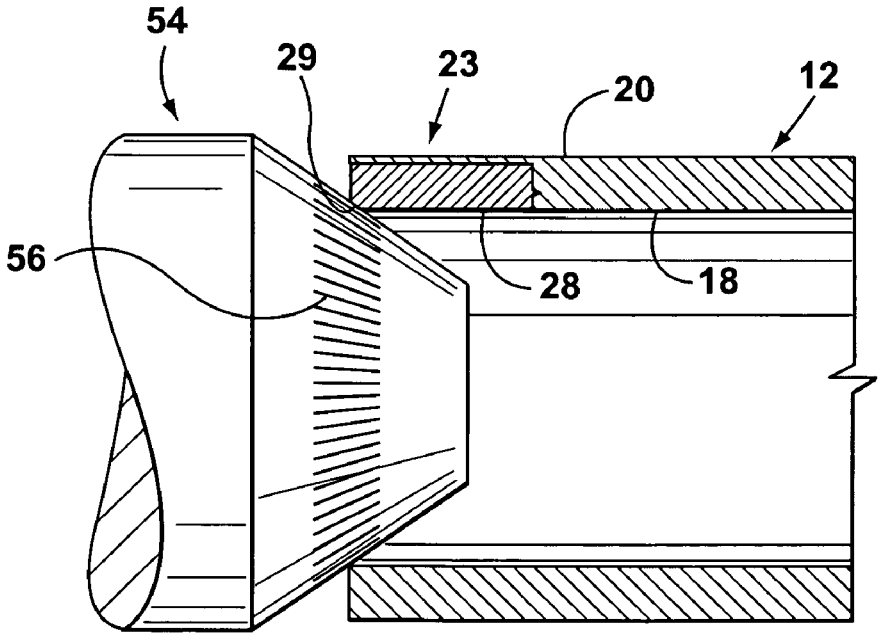
FIG. 7 is a similar view showing a tubular core assembly with a non-recessed lug engaged by a stub-shaft with splines.

FIG. 6 shows one end of the tubular core assembly engaged by a stub-shaft 50 with a key 52, the key 52 being engaged in the lug recess 24. FIG. 7 shows one end of the tubular core assembly with a lug 23 which is the same as the lug 22 except that is does not have a recess 24. The tubular core assembly is engaged by a stub-chuck 54 with splines 56, some of which engage the lower surface 28 of the lug 22 at its front end, which may be chambered as shown at 29. In each case, the inner surface or surfaces of the lug 22 or 23 engage at least about 2.25% of the periphery of the stub-chuck 50 or 54.

The advantages of the invention will now be readily apparent to a person skilled in the art from the foregoing description of a preferred embodiment. Other advantages and embodiments will also be readily apparent, the scope of the invention being defined in the appended claims.

The invention claimed is:

1. A tubular core assembly for a roll of paper or other sheet material having a hollow cylindrical core member formed of paperboard material, said core member having a recess extending axially inwardly from an end thereof and radially outwardly from an inner surface thereof at least partway to an outer surface thereof, said core member recess having opposed side surfaces and a rear surface extending upwardly from said inner surface, and a stand-alone lug of non-isotropic polymeric or cellulosic material in the core member recess, said lug having side surfaces extending from top to bottom and from front to rear of said lug and a rear surface extending from said top to said bottom and from side to side of said lug, said lug side surfaces engaging the side surfaces of the core member recess and said lug rear surface engaging the rear surface of the core member recess, the core member having an outer diameter in the range of from about 3 to about 14 inches and an inner diameter in the range of from about 2 to about 13 inches, the core member recess and the lug each having a circumferential width in the range of from about 0.25 to about 4 inches, an axial length in the range of from about 0.5 to about 4 inches, and a radial thickness in the range of from about 0.25 to about 1 inch, and the lug having at least one radially inner surface flush with the inner surface of the core member adjacent the end thereof, the total circumferential width of the inner surface or surfaces of the lug being at least about 0.2 inches, said lug having a recess for receiving a key on a stub-chuck, said lug recess extending axially inwardly from an end of the lug adjacent said end of the core member, and said lug recess extending radially outwardly from an inner surface of the lug only partway to an outer surface thereof, whereby the lug has a roof portion over the recess.

2. A tubular core assembly according to claim 1 wherein the core member recess and the lug recess are rectangular in plan view.

3. A tubular core assembly according to claim 1 wherein the lug recess has a circumferential width in the range of from about 0.125 to about 3 inches and an axial length in the range of from about 0.25 to about 3.75 inches.

4. A tubular core assembly according to claim 1 wherein the lug has an axially extending spline projecting from at least one side surface and digging into a side of the core member recess to assist in positioning the lug therein.

5. A tubular core assembly according to claim 1 wherein the lug has at least one rear spline projecting therefrom and digging into a rear surface of the core member recess to assist in positioning the lug therein.

6. A tubular core assembly according to claim 1 wherein the lug has a pair of stabilizers each projecting from the bottom of a respective side wall thereof adjacent an inner surface of the core member to stabilize the lug when engaged by a stub-chuck.

7. A tubular core assembly according to claim 1 wherein the total circumferential width of the inner surface or surfaces of the lug is at least about 0.4 inches.

8. A tubular core assembly according to claim 1 mounted on a stub-chuck, the inner surface or surfaces of the lug engaging at least about 2.25% of the periphery of the stub-chuck.

9. A stand-alone lug of non-isotropic polymeric or cellulosic material for installation in a recess in a core member of paperboard material for a roll of paper or other sheet material, said lug having side surfaces extending from top to bottom and from front to rear of said lug and a rear surface extending from said top to said bottom and from side to side of said lug, said surfaces contacting said recess in said paper board cores, said lug having a width in the range of from about 0.25 to about 4 inches, a length in the range of from about 0.5 to about 4 inches, and a thickness in the range of from about 0.25 to about 1 inch, and said lug also having at least one radially inner surface, the total circumferential width of the inner surface or surfaces being at least about 0.2 inches, said lug having a recess extending from one end thereof for receiving a key on a stub-chuck, the recess extending radially outwardly from an inner surface of the lug only partway to an outer surface thereof, whereby the lug has a roof portion over the recess.

10. A lug according to claim 9 wherein the recess is rectangular in plan view.

11. A lug according to claim 9 when the recess has a width in the range of from about 0.25 to about 3 inches and a length in the range of from about 0.25 to about 3.75 inches.

12. A lug according to claim 9 also having a spline projecting from at least one side surface thereof for digging into a side of a core member recess to assist in positioning the lug therein.

13. A lug according to claim 9 also having at least one rear spline projecting therefrom for digging into a rear surface of the core member recess to assist in positioning the lug therein.

14. A lug according to claim 9 also having a pair of stabilizers each projecting from the bottom of a respective side wall thereof so that in use the stabilizers are positioned adjacent an inner surface of the core member to stabilize the lug when engaged by a stub-chuck.

15. A lug according to claim 9 wherein the total circumferential width of the inner surface or surfaces is at least about 0.4 inches.

16. A tubular core assembly for a roll of paper or other sheet material having a hollow cylindrical core member formed of paperboard material, said core member having a recess extending axially inwardly from an end thereof and radially outwardly from an inner surface thereof at least partway to an outer surface thereof, said core member recess having opposed side surfaces and a rear surface extending upwardly from said inner surface, and a stand-alone lug of non-isotropic polymeric or cellulosic material in the core member recess, said lug having side surfaces extending from top to bottom and from front to rear of said lug and a rear surface extending from said top to said bottom and from side to side of said lug, said lug side surfaces engaging the side surfaces of the core member recess and said lug rear surface engaging the rear surface of the core member recess, the core member having an outer diameter in the range of from about 3 to about 14 inches and an inner diameter in the range of from about 2 to about 13 inches, the core member recess and the lug each having a circumferential width in the range of from about 0.25 to about 4 inches, an axial length in the range of from about 0.5 to about 4 inches, and a radial thickness in the range of from about 0.25 to about 1 inch, and the lug having at least one radially inner surface flush with the inner surface of the core member adjacent the end thereof, the total circumferential width of the inner surface or surfaces of the lug being at least about 0.2 inches, said lug having a recess for receiving a key on the stub-chuck, said lug recess extending axially inwardly from and end of the lug adjacent said end of the core member, and said lug recess extending axially inwardly from said end of the lug less than halfway along the length of the lug.

17. A tubular core assembly for a roll of paper or other sheet material having a hollow cylindrical core member formed of paperboard material, said core member having a recess extending axially inwardly from an end thereof and radially outwardly from an inner surface thereof at least partway to an outer surface thereof, said core member recess having opposed side surfaces and a rear surface extending upwardly from said inner surface, and a stand-alone lug of non-isotropic polymeric or cellulosic material in the core member recess, said lug having side surfaces extending from top to bottom and from front to rear of said lug and a rear surface extending from said top to said bottom and from side to side of said lug, said lug side surfaces engaging the side surfaces of the core member recess and said lug rear surface engaging the rear surface of the core member recess, the core member having an outer diameter in the range of from about 3 to about 14 inches and an inner diameter in the range of from about 2 to about 13 inches, the core member recess and the lug each having a circumferential width in the range of from about 0.25 to about 4 inches, an axial length in the range of from about 0.5 to about 4 inches, and a radial thickness in the range of from about 0.25 to about 1 inch, and the lug having at least one radially inner surface flush with the inner surface of the core member adjacent the end thereof, the total circumferential width of the inner surface or surfaces of the lug being at least about 0.2 inches, said lug having an unrecessed lower surface extending for the circumferential width thereof for engagement by splines on a stub-chuck.

18. A stand-alone lug of non-isotropic polymeric or cellulosic material for installation in a recess in a core member of paperboard material for a roll of paper or other sheet material, said lug having side surfaces extending from top to bottom and from front to rear of said lug and a rear surface extending from said top to said bottom and from side to side of said lug, said surfaces contacting said recess in said paper board core, said lug having a width in the range of from about 0.25 to about 4 inches, a length in the range of from about 0.5 to about 4 inches, and a thickness in the range of from about 0.25 to about 1 inch, and said lug also having at least one radially inner surface, the total circumferential width of the inner surface or surfaces being at least about 0.2 inches, said lug having a recess extending from one end thereof for receiving a key on a stub-chuck, the recess extending axially inwardly from said end of the lug less than halfway along the length of the lug.

19. A stand-alone lug of non-isotropic polymeric or cellulosic material for installation in a recess in a core member of paperboard material for a roll of paper or other sheet material, said lug having side surfaces extending from top to bottom and from front to rear of said lug and a rear surface extending from said top to said bottom and from side to side of said lug, said surfaces contacting said recess in said paper board core, said lug having a width in the range of from about 0.25 to about 4 inches, a length in the range of from about 0.5 to about 4 inches, and a thickness in the range of from about 0.25 to about 1 inch, and said lug also having at least one radially inner surface, the total circumferential width of the inner surface or surfaces being at least about 0.2 inches, said lug having an unrecessed lower surface extending for the circumferential width thereof for reengagement by splines on a stub-chuck.

* * * * *